US010429110B2

(12) United States Patent
Brown et al.

(10) Patent No.: US 10,429,110 B2
(45) **Date of Patent: *Oct. 1, 2019**

(54) SYSTEM AND METHOD FOR RECOVERING REFRIGERANT

(71) Applicants: Bosch Automotive Service Solutions Inc., Warren, MI (US); Robert Bosch GmbH, Stuttgart (DE)

(72) Inventors: William C. Brown, Owatonna, MN (US); Dylan M. Lundberg, Lonsdale, MN (US); Mark W. McMasters, Owatonna, MN (US); Jacob Hanson, Owatonna, MN (US)

(73) Assignees: Bosch Automotive Service Solutions Inc., Warren, MI (US); Robert Bosch GmbH, Stuttgart (DE)

( * ) Notice: Subject to any disclaimer, the term of this patent is extended or adjusted under 35 U.S.C. 154(b) by 513 days.

This patent is subject to a terminal disclaimer.

(21) Appl. No.: 14/757,633

(22) Filed: Dec. 23, 2015

(65) Prior Publication Data

US 2016/0187042 A1 Jun. 30, 2016

Related U.S. Application Data

(60) Provisional application No. 62/098,129, filed on Dec. 30, 2014.

(51) Int. Cl.
*F25B 45/00* (2006.01)

(52) U.S. Cl.
CPC ..... *F25B 45/00* (2013.01); *F25B 2345/001* (2013.01); *F25B 2345/002* (2013.01);
(Continued)

(58) Field of Classification Search
CPC ..... F25B 2345/002; F25B 2345/003; F25B 2345/007; F25B 45/00
(Continued)

(56) References Cited

U.S. PATENT DOCUMENTS 4,285,206 A * 8/1981 Koser ..... B60H 1/00585 62/126
5,046,322 A * 9/1991 Bulla ..... F25B 45/00 177/127

(Continued)

*Primary Examiner* — Filip Zec
(74) *Attorney, Agent, or Firm* — Maginot Moore & Beck LLP

(57) ABSTRACT

An air conditioning service system includes a plurality of conduits and voids defining a total refrigerant receiving volume of the air conditioning service system, a pressure transducer configured to sense a pressure at a first location in the plurality of conduits and voids, a compressor operably connected to the plurality of conduits and voids, and a controller. The controller determines a quantity of refrigerant recovered from a refrigeration system by obtaining a first pressure signal from the pressure transducer corresponding to a first pressure at the first location, operating the compressor to recover the refrigerant from the refrigeration system after the first pressure is sensed, obtaining a second pressure signal from the pressure transducer corresponding to a second pressure at the first location after operating the compressor, and determining an amount of refrigerant recovered from the refrigeration system based on the first pressure signal an the second pressure signal.

16 Claims, 5 Drawing Sheets

(52) U.S. Cl.
CPC ... *F25B 2345/003* (2013.01); *F25B 2345/006* (2013.01); *F25B 2345/007* (2013.01); *F25B 2345/0052* (2013.01)

(58) Field of Classification Search
USPC ..... 62/77, 149, 292
See application file for complete search history.

(56) References Cited

U.S. PATENT DOCUMENTS

| | | | | |
|---|---|---|---|---|
| 5,231,841 | A * | 8/1993 | McClelland | F25B 45/00 62/125 |
| 5,758,506 | A * | 6/1998 | Hancock | B60H 1/00585 62/149 |
| 6,442,963 | B1 * | 9/2002 | Pfefferle | B60H 1/00585 62/144 |
| 7,210,300 | B2 * | 5/2007 | Suharno | B60H 1/00585 62/292 |
| 8,800,306 | B2 * | 8/2014 | Schoenoff | F04B 9/047 417/273 |
| 9,448,140 | B2 * | 9/2016 | Ulrich | F25B 45/00 |
| 2011/0132018 | A1 * | 6/2011 | Chang | F25B 45/00 62/298 |
| 2012/0247131 | A1 * | 10/2012 | Esch | B60H 1/00585 62/77 |
| 2012/0324922 | A1 | 12/2012 | McMasters et al. | |
| 2013/0312434 | A1 * | 11/2013 | Sanhaji | F25B 45/00 62/77 |
| 2013/0319025 | A1 | 12/2013 | Wagaman et al. | |

* cited by examiner

SYSTEM AND METHOD FOR RECOVERING REFRIGERANT

CROSS-REFERENCE TO RELATED APPLICATION

This application claims priority to U.S. Provisional Application Ser. No. 62/098,129 entitled "System and Method for Recovering Refrigerant," filed Dec. 30, 2014, the disclosure of which is hereby incorporated herein by reference in its entirety.

TECHNICAL FIELD

This disclosure relates generally to refrigeration systems, and more particularly to refrigerant recovery systems for refrigeration systems.

BACKGROUND

Air conditioning systems are currently commonplace in homes, office buildings and a variety of vehicles including, for example, automobiles. Over time, the refrigerant included in these systems becomes depleted and/or contaminated. As such, in order to maintain the overall efficiency and efficacy of an air conditioning system, the refrigerant included therein may be periodically replaced or recharged.

Portable carts, also known as recover, recycle, recharge ("RRR") refrigerant service carts or air conditioning service ("ACS") units, are used in connection with servicing refrigeration circuits, such as the air conditioning unit of a vehicle. The portable machines include hoses coupled to the refrigeration circuit to be serviced. The ACS unit operates to recover refrigerant from the vehicle's air conditioning unit, purify the refrigerant, and subsequently recharge the system from a supply of either recovered refrigerant or new refrigerant from a refrigerant tank.

During the recovery process, there is a need to accurately measure the amount of refrigerant that is removed from the system in order to troubleshoot possible causes of the system failure and also to track the amount of refrigerant used.

Typical ACS units are configured to initiate a "clearing" process prior to a recovery routine to reduce the amount of refrigerant in the ACS unit on the low pressure side of the compressor. This clearing process allows removal of most of the residual refrigerant from the high and low pressure sides of the unit. Removing this refrigerant prior to and following a recovery is important so that the difference between the initial and final weight of the refrigerant tank provides an accurate determination of the amount of refrigerant recovered for the user. The unit uses the compressor and solenoid valves to remove any residual refrigerant that may have been left behind in a previous process. Currently, ACS units measure the removal of the refrigerant by reading a pressure transducer in the low pressure side of the unit while using the compressor and solenoid valves to pull the refrigerant out of the low pressure side of the unit until the pressure is sufficiently low that the amount of refrigerant is assumed to be negligible.

The problem with the prior art clearing process, however, is that the entire quantity of refrigerant cannot be accounted for. The compressor pressurizes the refrigerant pulled from the low-pressure side of the unit and transfers the refrigerant to the high pressure side of the unit. Upon deactivating of the compressor, a small, but non-negligible, quantity remains in the plumbing and chambers in the high pressure side of the ACS unit. Depending on the ambient conditions and the state of the unit prior to the clearing process, the refrigerant remaining in the high pressure side of the unit can substantially affect the accuracy of the determined recovered weight of refrigerant.

Furthermore, the clearing process also requires the ACS unit to have additional solenoid valves and check valves to properly perform the clearing process and enable an accurate determination of refrigerant recovered. The additional valves require more plumbing, wiring, and machining, all of which increase the initial and maintenance costs of the ACS unit. Additionally, the clearing operation requires additional time to complete, adding, in some systems, one minute or more to the length of the recovery operation.

What is needed, therefore, is a refrigerant recovery unit that accurately calculates the amount of refrigerant recovered during a refrigerant recovery process using fewer valves. Additionally, a refrigerant recovery unit that can calculate the amount of refrigerant remaining in the plumbing and chambers of the unit without performing a clearing operation would be desirable.

SUMMARY

An air conditioning service system according to the disclosure includes a plurality of conduits and voids defining a total refrigerant receiving volume of the air conditioning service system, a pressure transducer configured to sense a pressure at a first location in the plurality of conduits and voids, a compressor operably connected to the plurality of conduits and voids, and a controller operably connected to the pressure transducer and the compressor. The controller includes a processor configured to execute program instructions stored in a memory to determine a quantity of refrigerant recovered from a refrigeration system by: obtaining a first pressure signal from the pressure transducer corresponding to a first pressure at the first location, operating the compressor to recover the refrigerant from the refrigeration system after the first pressure is sensed, obtaining a second pressure signal from the pressure transducer corresponding to a second pressure at the first location after operating the compressor, and determining an amount of refrigerant recovered from the refrigeration system based on the first pressure signal an the second pressure signal.

In some embodiments of the air conditioning service system, the controller is configured to execute the program instructions to determine the quantity of refrigerant recovered by determining a change in mass of refrigerant in the conduits and voids from before operating the compressor to after operating the compressor based on the first and second pressure signals, and determining the amount of refrigerant recovered from the refrigeration system based on the determined change in mass.

In further embodiments, the controller is configured to execute the program instructions to determine the change in mass of refrigerant based upon the following equation:

$$\Delta m = \frac{MV}{R}\left(\frac{P_2}{T_2} - \frac{P_1}{T_1}\right),$$

wherein $\Delta m$ is the change in mass of refrigerant, M is a molar mass of the refrigerant, V is a volume fluidly connected to the first location, R is the universal gas constant, $P_2$ is the second pressure, $T_2$ is a second temperature associated with the second pressure, $P_1$ is the first pressure, and $T_1$ is a first temperature associated with the first pressure.

In one embodiment, the air conditioning service system further comprises a refrigerant storage vessel and a scale configured to sense a weight of the refrigerant storage vessel. The controller is operably connected to the scale and is configured to execute the program instructions to determine the quantity of refrigerant recovered by obtaining a first weight signal from the scale corresponding to a first weight of the refrigerant storage vessel prior to operating the compressor, obtaining a second weight signal from the scale corresponding to a second weight of the refrigerant storage vessel after operating the compressor, and determining the amount of refrigerant recovered from the refrigeration system based on the first weight signal and the second weight signal.

In another embodiment of the air conditioning service system, the controller is configured to execute the program instructions to determine the amount of refrigerant recovered from the refrigeration system based upon the following equation:

$$W_{rec} = W_{2,isv} - W_{1,isv} - \frac{gMV}{R}\left(\frac{P_2}{T_2} - \frac{P_1}{T_1}\right),$$

wherein $W_{rec}$ is the amount of refrigerant recovered from the refrigeration system expressed as a weight, $W_{2,isv}$ is the second weight of the refrigerant storage vessel, $W_{1,isv}$ is the first weight of the refrigerant storage vessel, and g is the gravitational constant.

In some embodiments, the air conditioning service further comprises a temperature sensor configured to sense a temperature of the air conditioning service system. The controller is operably connected to the temperature sensor and is configured to execute the program instructions to determine the quantity of refrigerant recovered by obtaining a first temperature signal from the temperature sensor corresponding to the first temperature and obtaining a second temperature signal from the temperature sensor corresponding to the second temperature.

In another embodiment, the plurality of conduits and voids includes a first portion connected to a high pressure side of the compressor and a second portion connected to a low pressure side of the compressor and the air conditioning system further comprises a valve configured to control a connection between the first portion and the second portion. The pressure transducer is configured to sense a pressure in the second portion, and the controller is operably connected to the valve and is configured to execute the program instructions to determine the quantity of refrigerant recovered by operating the valve to an open position to equalize pressure between the first portion and the second portion prior to obtaining the first pressure signal and operating the valve to an open position to equalize pressure between the first portion and the second portion after operating the compressor and prior to obtaining the second pressure signal.

In yet another embodiment, the plurality of conduits and voids includes a first portion connected to a high pressure side of the compressor and a second portion connected to a low pressure side of the compressor and the pressure transducer is configured to sense a pressure in the first portion.

In another embodiment according to the disclosure, a method of operating an air conditioning service system to determine a quantity of refrigerant recovered from a refrigeration system includes obtaining, with a controller, a first pressure signal from a pressure transducer corresponding to a first pressure at a first location in a plurality of conduits and voids defining a total refrigerant receiving volume of the air conditioning service system, operating, using the controller, a compressor to recover the refrigerant from the refrigeration system after the first pressure is sensed by the pressure transducer, obtaining, with the controller, a second pressure signal from the pressure transducer corresponding to a second pressure at the first location after operating the compressor, and determining, with the controller, an amount of refrigerant recovered from the refrigeration system based on the first pressure signal an the second pressure signal.

In some embodiments, the method further comprises determining, with the controller a change in mass of refrigerant in the conduits and voids from before operating the compressor to after operating the compressor based on the first and second pressure signals, and determining the amount of refrigerant recovered from the refrigeration system based on the determined change in mass.

In another embodiment of the method, the determining of the change in mass of refrigerant based upon the following equation:

$$\Delta m = \frac{MV}{R}\left(\frac{P_2}{T_2} - \frac{P_1}{T_1}\right),$$

wherein $\Delta m$ is the change in mass of refrigerant, M is the molar mass of the refrigerant, V is a volume fluidly connected to the first location, R is the universal gas constant, $P_2$ is the second pressure, $T_2$ is a second temperature associated with the second pressure, $P_1$ is the first pressure, and $T_1$ is a first temperature associated with the first pressure.

In yet another embodiment, the method further comprises obtaining a first weight signal from a scale configured to sense a weight of a refrigerant storage vessel operably connected to the plurality of conduits and voids, the first weight signal corresponding to a first weight of the refrigerant storage vessel prior to operating the compressor, obtaining a second weight signal from the scale corresponding to a second weight of the refrigerant storage vessel after operating the compressor, and determining the amount of refrigerant recovered from the refrigeration system based upon the first weight signal and the second weight signal.

In some embodiments of the method, the determining of the amount of refrigerant recovered from the refrigeration system is based upon the following equation:

$$W_{rec} = W_{2,isv} - W_{1,isv} - \frac{gMV}{R}\left(\frac{P_2}{T_2} - \frac{P_1}{T_1}\right),$$

wherein $W_{rec}$ is the amount of refrigerant recovered from the refrigeration system expressed as a weight, $W_{2,isv}$ is the second weight, $W_{1,isv}$ is the first weight, and g is the gravitational constant.

In one embodiment, the method further comprises obtaining a first temperature signal from a temperature sensor configured to sense a temperature of the air conditioning service system, the first temperature signal corresponding to the first temperature, and obtaining a second temperature signal from the temperature sensor corresponding to the second temperature.

In a further embodiment, the method further comprises operating, with the controller, prior to obtaining the first pressure signal, a valve to an open position to fluidly connect a first portion of the plurality of conduits and voids connected to a high pressure side of the compressor and a second portion of the plurality of conduits and voids connected to a low pressure side of the compressor to equalize pressure between the first portion and the second portion. The method further includes operating, with the controller, the valve to an open position to equalize pressure between the first portion and the second portion after operating the compressor and prior to obtaining the second pressure signal. The pressure transducer is configured to sense a pressure in the second portion.

In some embodiments of the method, the plurality of conduits and voids includes a first portion connected to a high pressure side of the compressor and a second portion connected to a low pressure side of the compressor, and the pressure transducer is configured to sense a pressure in the first portion.

In another embodiment according to the disclosure, an air conditioning service system comprises a plurality of conduits and voids defining a total refrigerant receiving volume of the air conditioning service system, a pressure transducer configured to sense a pressure at a first location in the plurality of conduits and voids, a refrigerant storage vessel, a first valve configured to control a fluid connection between the first location and the refrigerant storage vessel, and a compressor operably connected to the plurality of conduits and voids. A controller is operably connected to the pressure transducer, the compressor, and the first valve. The controller includes a processor configured to execute program instructions stored in a memory to recover refrigerant from a refrigeration system by: obtaining a first pressure signal from the pressure transducer corresponding to a first pressure at the first location, operating the compressor to recover the refrigerant from the refrigeration system, operating the first valve to an open position to fluidly connect the first location to the refrigerant storage vessel, monitoring, using the pressure transducer, a second pressure at the first location, and operating the first valve to a closed position when the second pressure is equal to or greater than the first pressure.

In one particular embodiment, the plurality of conduits and voids includes a first portion connected to a high pressure side of the compressor and a second portion connected to a low pressure side of the compressor. The air conditioning system further comprises a second valve configured to control a fluid connection between the first portion and the second portion and the pressure transducer is configured to sense a pressure in the second portion. The controller is operably connected to the second valve and is configured to execute the program instructions to recover the refrigerant from the refrigeration system by operating the valve to an open position to equalize pressure between the first portion and the second portion prior to obtaining the first pressure signal, and operating the valve to an open position to equalize pressure between the first portion and the second portion after operating the compressor and prior to operating the first valve to open.

In another embodiment, the plurality of conduits and voids includes a first portion connected to a high pressure side of the compressor and a second portion connected to a low pressure side of the compressor, and the pressure transducer is configured to sense a pressure in the first portion.

In another embodiment, the air conditioning service system further comprises a scale configured to sense a weight of the refrigerant storage vessel. The controller is operably connected to the valve and is configured to execute the program instructions determine a quantity of refrigerant recovered from the refrigeration system by obtaining a first mass signal from the scale corresponding to a first mass of the refrigerant storage vessel before operating the compressor, obtaining a second mass signal from the scale corresponding to a second mass of the refrigerant storage vessel after operating the first valve to close, and determining an amount of refrigerant recovered from the refrigeration system based upon the first mass signal and the second mass signal.

DETAILED DESCRIPTION

For the purposes of promoting an understanding of the principles of the embodiments described herein, reference is now made to the drawings and descriptions in the following written specification. No limitation to the scope of the subject matter is intended by the references. This disclosure also includes any alterations and modifications to the illustrated embodiments and includes further applications of the principles of the described embodiments as would normally occur to one skilled in the art to which this document pertains.

Figure 1:
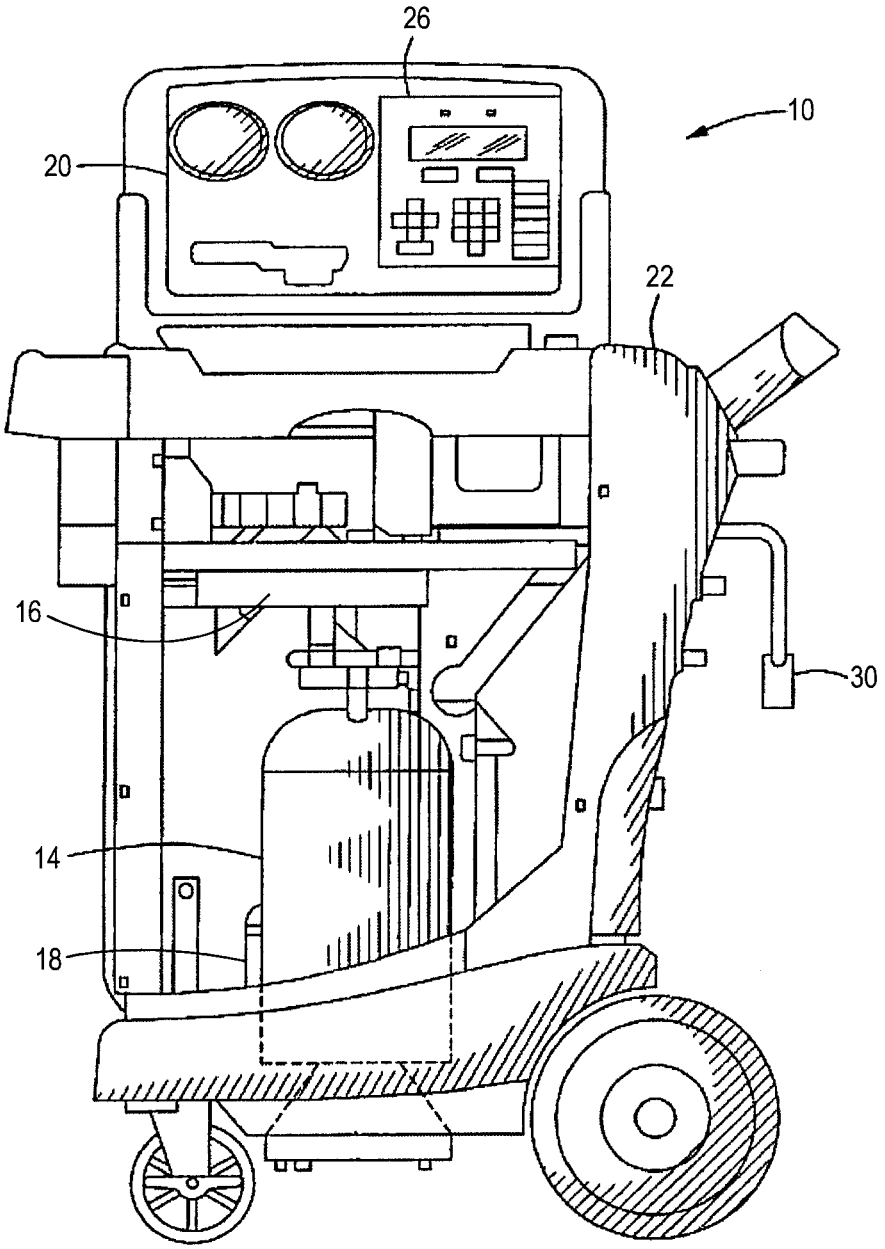
FIG. 1 is a partial cutaway front view of an ACS system according to the disclosure.

FIG. 1 is an illustration of an air conditioning service ("ACS") system 10 according to the disclosure. The ACS unit 10 includes a refrigerant container or internal storage vessel ("ISV") 14, a manifold block 16, a compressor 18, a control module 20, and a housing 22. The exterior of the control module 20 (also referred to herein as a controller) includes an input/output unit 26 for input of control commands by a user and output of information to the user. Hose connections 30 (only one is shown in FIG. 1) protrude from the housing 22 to connect to service hoses that connect to an air conditioning ("A/C") system and facilitate transfer of refrigerant between the ACS unit 10 and the A/C system.

The ISV 14 is configured to store refrigerant for the ACS system 10. No limitations are placed on the kind of refrigerant that may be used in the ACS system 10, also referred to as an ACS machine or RRR unit. As such, the ISV 14 is configured in different embodiments to accommodate any refrigerant that is desired to be charged to the A/C system. In some embodiments, the ISV 14 is particularly configured to accommodate one or more refrigerants that are commonly used in the A/C systems of vehicles (e.g., cars, trucks, boats, planes, etc.), for example R-134a, $CO_2$, or R1234yf. In some embodiments, the ACS unit has multiple ISV tanks configured to store different refrigerants.

The manifold block 16 is fluidly connected to the ISV 14, the compressor 18, and the hose connections 30 through a series of valves, hoses, and tubes. The manifold block 16 includes components configured to filter and purify refrigerant recovered from a vehicle during a refrigerant recovery operation prior to the refrigerant being stored in the ISV 14.

Figure 2:
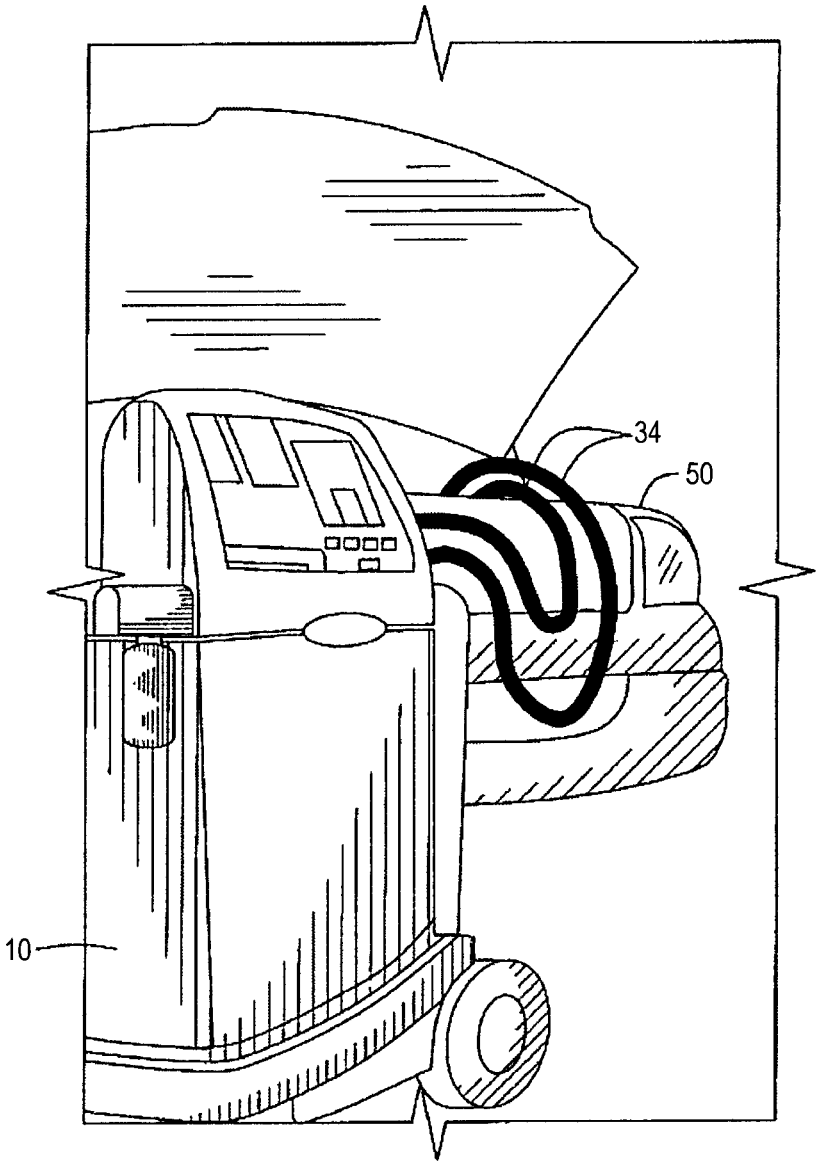
FIG. 2 is side perspective view of the ACS system of FIG. 1 connected to a vehicle.

FIG. 2 is an illustration of a portion of the air conditioning recharging system 10 illustrated in FIG. 1 connected to a vehicle 50. One or more service hoses 34 connect an inlet and/or outlet port of the A/C system of the vehicle 50 to the hose connections 30 (shown in FIG. 1) of the ACS unit 10.

Figure 3:
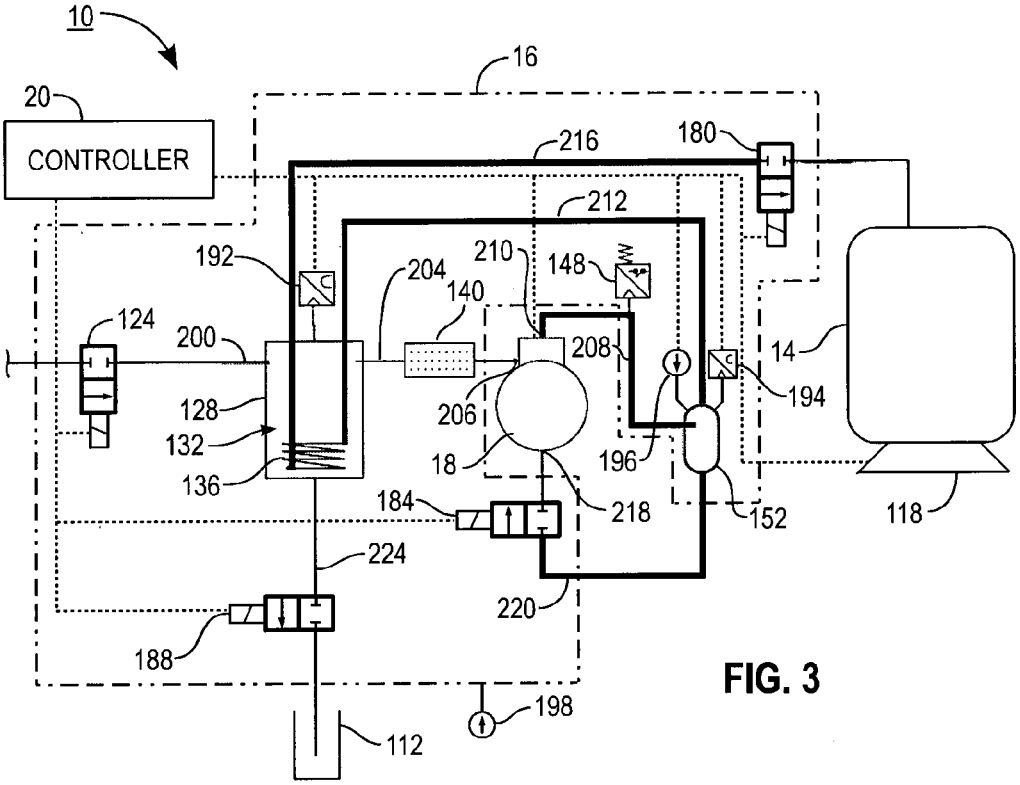
FIG. 3 is a schematic view of the ACS system of FIG. 1 showing the pressurized areas after the recovery operation.

FIG. 3 schematically illustrates the ACS system 10, for servicing an air conditioning system, such as the air conditioning system in the vehicle 50 of FIG. 2. The ACS system 10 includes the manifold 16, the compressor 18, an oil drain receptacle 112, the ISV 14, and the control module 20. The ISV 14 includes a scale 118, which, in one embodiment, is a load cell, configured to sense the mass of the ISV 14.

The manifold 16 includes an inlet solenoid valve 124, a system oil separator 128 (also referred to as an accumulator) having a chamber 132 in which a heat exchanger 136 is mounted, a filter and dryer unit 140, a high-pressure switch 148, a compressor oil separator 152, recovery outlet solenoid valve 180, an oil return solenoid valve 184, and an oil drain solenoid valve 188.

An accumulator pressure transducer 192 is configured to sense the pressure in the system oil separator 128 and to generate an electronic signal corresponding to the pressure in the system oil separator 128. The system 10 further includes a high-side pressure transducer 194 configured to sense the pressure in the system on the high-pressure side of the compressor 18, a high-side temperature sensor 196 configured to sense the temperature in the system on the high pressure side of the compressor 18, and an ambient temperature sensor 198 configured to sense the ambient temperature outside the ACS system 10. In the illustrated embodiment, the high-side pressure transducer and temperature sensor 194, 196 are connected to the compressor oil separator 152, though the sensors may be located in other areas on the high-pressure side of the compressor 18 in other embodiments. Additionally, some ACS systems may not include all of the sensors 192, 194, 196, 198, and may include, for example, only the pressure transducer 192 in the system oil separator 128 or only the pressure transducer 194 in the compressor oil separator 152.

The manifold 16 further includes a variety of connecting conduits defined in the manifold block to connect the various components of the manifold 16 with the compressor 18, the oil drain receptacle 112, and the ISV 14. For simplicity of illustration, the conduits internal to the manifold 16 and the conduits extending out of the manifold 16 to make these connections and plumbing are described herein as connecting lines, flow lines, or lines, though the reader should appreciate that the fluid connections between the components can be made in any suitable manner and may include any combination of pipes, hoses, and tubes. The entire volume of the ACS system 10 which contains refrigerant is defined by a plurality of conduits and voids.

The system 10 includes a refrigerant input line 200, which is configured to be opened and closed by the inlet valve 124. The refrigerant input line 200 is configured to receive refrigerant, typically from a vehicle being serviced (for example vehicle 50), and is connected to an inlet of the system oil separator 128. The outlet of the system oil separator 128 is connected to a compressor low-side line 204, which fluidly connects the system oil separator 128 via the filter and dryer unit 140 into the low pressure side of the compressor 18.

A compressor high-side line 208 fluidly connects the high pressure side 210 of the compressor 18 to the compressor oil separator 152, and the high-pressure switch 148 is connected to the compressor high-side line 208. The compressor oil separator 152 is fluidly connected to the heat exchanger 136 in the system oil separator 128 by a compressor oil separator outlet line 212, and the recovery outlet solenoid valve 180 controls a fluid connection between the outlet of the heat exchanger 136 to the ISV 14 through a recovery outlet line 216.

The oil return solenoid valve 184 opens and closes a fluid connection between the compressor oil separator 152 and an oil return port 218 of the compressor 18 through a compressor oil return line 220 to enable oil separated from refrigerant in the compressor oil separator 152 to be returned to the compressor 18.

An oil drain line 224 connects the system oil separator 128 to the oil drain receptacle 112 to enable oil separated in the system oil separator 128 to be stored in the oil drain receptacle 112, and the oil drain solenoid 188 is configured to open and close the fluid connection between the system oil separator 128 and the oil drain receptacle 112.

The controller 20 is operatively connected to the system oil separator pressure transducer 192, the compressor 18, the inlet solenoid valve 124, the recovery outlet solenoid valve 180, the oil return solenoid valve 184, and the oil drain solenoid valve 188. The controller 20 is configured to selectively activate the solenoid valves 124, 180, 184, and 188, and the compressor 18. The system oil separator pressure transducer 192 and the high-side pressure transducer 194 are configured to transmit a signal indicative of the pressure within the system oil separator 128 and the compressor oil separator 152, respectively, to the controller 20. The high-side temperature sensor 196 and the ambient temperature sensor 198 are configured to transmit an electronic signal representing the temperature in the compressor oil separator 152 and the ambient temperature, respectively, to the controller 20.

Operation and control of the various components and functions of the ACS system 10 are performed with the aid of the controller 20. The controller 20 is implemented with general or specialized programmable processors that execute programmed instructions. The instructions and data required to perform the programmed functions are stored in a memory unit associated with the controller 20. The processors, memory, and interface circuitry configure the controller 20 to perform the functions described above and the processes described below. These components are provided on a printed circuit card or provided as a circuit in an application specific integrated circuit (ASIC). In some embodiments, each of the circuits is implemented with a separate processor, while in other embodiments, multiple circuits are implemented on the same processor. Alternatively, in further embodiments, the circuits are implemented with discrete components or circuits provided in VLSI circuits. In various embodiments, the circuits described herein are implemented with a combination of processors, ASICs, discrete components, or VLSI circuits.

During a refrigerant recovery operation, an operator connects the ACS machine 10 to service ports of an air conditioning system, for example an air conditioning system for a vehicle 50 shown in FIG. 2. To initiate a recovery operation, the controller 20 activates a series of valves, including the recovery inlet valve 124, to open a path from the air conditioning system to the inlet line 200. The compressor 18 is activated, pulling refrigerant in the air conditioning system through the input line 200 and into the chamber 132 of the system oil separator 128, where the heat from the heat exchanger 136 vaporizes the refrigerant.

A small amount of system oil is typically entrained in the refrigerant during normal use in the air conditioning system. The system oil has a higher boiling point than the refrigerant, and therefore remains in a liquid phase and falls to the bottom of the system oil separator chamber 132 under the force of gravity as the recovered refrigerant is vaporized in the system oil separator 128. The system oil accumulates at the bottom of the system oil separator chamber 132 until the system oil drain solenoid valve 188 is opened during an oil drain process, enabling the system oil to flow through the oil drain 176 and the system oil drain line 224 into the system oil receptacle 112.

During the recovery operation, the negative pressure produced by the compressor 18 moves the refrigerant vapor out of the chamber 132 of the system oil separator 128 and into the filter and dryer unit 140, which removes moisture and other contaminants present in the refrigerant. The refrigerant vapor continues through the compressor low-side line 204 into the low pressure side 206 of the compressor 18. The compressor 18 pressurizes the refrigerant, which increases the temperature of the refrigerant and forces the refrigerant out the high pressure side 210 of the compressor 18 and through the compressor high-side line 208 past the high pressure switch 148, which is configured to deactivate the compressor if the pressure downstream of the compressor 18 exceeds a threshold value to prevent excess pressure in the components downstream of the compressor 18. During the pass through the compressor 18, the temperature of the refrigerant increases substantially, such that the refrigerant in the compressor high-side line 208 is hotter than the refrigerant coming into the system.

The heated and pressurized refrigerant then enters the compressor oil separator 152. As the refrigerant enters the compressor oil separator 152, the compressor oil entrained in the refrigerant during the pass through the compressor 18 separates from the vapor-phase refrigerant. The compressor oil remains in the compressor oil separator 152, while the refrigerant vapor passes into the compressor oil separator outlet line 212 and moves into the heat exchanger 136 located in the system oil separator 128. The refrigerant passing through the heat exchanger 140 is still at a greater temperature than the refrigerant entering the system oil separator 128, and therefore transfers heat to the system oil separator chamber 132 to assist in vaporizing the refrigerant entering the system, as described above. The refrigerant passes through the recovery outlet line 216 and the open recovery outlet solenoid valve 180 into the ISV 14, where the refrigerant is stored to be subsequently recharged into an air conditioning system.

At the termination of the refrigerant recovery operation, the solenoid valves 124, 180, 184, and 188 are all in their respective closed positions, as shown in FIG. 3, isolating the components in the manifold block 16 from the air conditioning system and the ISV 14. The input line 200, the chamber 132 of the system oil separator 128, the compressor low-side line 204, and the filter and dryer unit 140 are all at vacuum pressure since these components are all on the low pressure side of the compressor 18. The compressor high-side line 208, compressor oil separator 152, compressor oil separator outlet line 212, heat exchanger 136, recovery outlet line 216, and the portion of the compressor oil return line 220 on the compressor oil separator 152 side of the oil return solenoid valve 184 are all pressurized (illustrated with a thick line in FIG. 3) since these components are on the high pressure side of the compressor 18. The components on the pressurized side of the compressor 18 retain a quantity of pressurized refrigerant, which can vary due to tank pressure, temperature, constrictions in the tubing of the lines, and other variables. Since the ISV scale 118 only measures the weight of the ISV 14, the ISV scale 118 is not capable of measuring the weight of the refrigerant remaining in the system.

The controller 20 is configured to calculate the quantity of refrigerant remaining in the system 10 so that the overall quantity of refrigerant recovered from the system can be accurately determined.

The controller 20 calculates the volume of refrigerant in the system in the high-pressure side of the compressor 18 using the ideal gas law. According to the ideal gas law, $$P*V=n*R*T$$

where P is the absolute pressure, V is volume, n is the quantity of gas in moles, R is the universal gas constant, and T is the temperature. The pressure (P) and temperature (T) are measured by the high side pressure transducer 194 and the high side temperature sensor 196, respectively. R is a constant, and the volume (V) in the high-side is a known quantity for a particular ACS system. As such, the controller 20 is configured to solve the ideal gas law for the quantity of gas and convert the quantity into a mass or a weight.

The controller 20 performs this calculation before and after a recovery operation, in addition to storing the mass of the ISV 14 as sensed by the scale 118. The controller 20 is configured to determine the total quantity of refrigerant recovered by subtracting the weight of the ISV 14 prior to the recovery process from the weight of the ISV 14 after the recovery process, and correcting this value by adding the difference between the weight of refrigerant in the system components and plumbing before and after the recovery process.

In one embodiment, the controller 20 is configured to obtain the signals corresponding to the pressure and temperature on the high pressure side of the system from the high-side pressure transducer 194 and the high-side temperature sensor 196, respectively. The volume in the high-pressure side of the system 10 is stored in a memory associated with the controller 20 and recalled to calculate the quantity of refrigerant remaining. The controller 20 is then configured to determine the number of moles of refrigerant by solving for the ideal gas law for the quantity of gas:

$$n = \frac{PV}{RT}$$

In order to solve for the mass of the gas, the number of moles is multiplied by the molar mass (M) of the gas. The resulting equation for the mass of the refrigerant (m) remaining then becomes:

$$m = M\frac{PV}{RT}$$

The molar mass is constant for a particular refrigerant, and the volume of the high-side of a particular ACS system is constant. As such, the equation can be simplified to:

$$m = k\frac{P}{T}$$

where k represents MV/R, which is constant for a particular ACS system using a particular refrigerant.

In one embodiment, the temperature in the high pressure side of the system is estimated or assumed as a constant, rather than acquiring a signal corresponding to the temperature in the high pressure side of the system. Such an embodiment may not include a high side temperature sensor, thereby reducing the overall cost of the ACS system.

Figure 4:
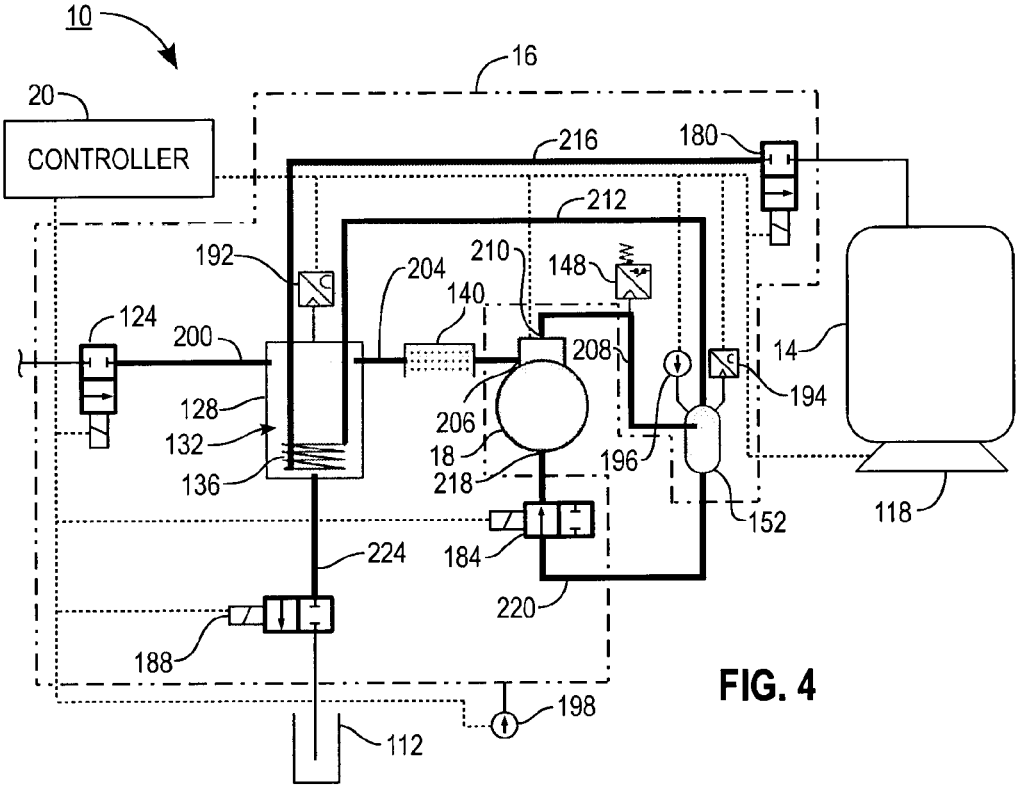
FIG. 4 is a schematic view of the ACS system of FIG. 3 having the oil drain valve opened to equalize pressure between the low pressure and high pressure sides of the ACS system.

In another embodiment, for example one that does not include a temperature sensor or pressure transducer in the high-pressure side of the system, the pressure sensed by the pressure transducer 192 in the system oil separator 128 is used in the ideal gas law calculation. The controller 20 is configured to recall data corresponding to the combined volume of the plumbing and chambers of the high-pressure and low-pressure sides of the ACS system 10 from the memory associated with the controller 20. The controller 20 is then configured to open the oil return solenoid valve 184, as shown in FIG. 4. The compressor oil return line 220 is connected to both the high pressure side of the compressor 18, via the compressor high-side line 208 and the compressor oil separator 152, and to the low pressure side of the compressor 18 via a connection within the compressor 18 between the oil return port 218 and the low pressure side 206. Opening the oil return solenoid valve 184 therefore transfers the pressurized refrigerant from the high pressure side to the low pressure side of the compressor 18 through the compressor oil return line 220, equalizing the pressure between the high pressure side 210 and the low pressure side 206 of the compressor 18.

Once the pressure has equalized, the controller 20 obtains the signal from the pressure transducer 192 in the compressor oil separator 128. In embodiments without any temperature sensors, an assumed temperature value is recalled by the controller 20 from the memory associated with the controller 20. In an embodiment having an ambient temperature sensor 198, the temperature reading is obtained from the ambient temperature sensor 198 and used as an approximation for the temperature in the high pressure side in the ideal gas law determination. In some embodiments, the controller 20 is configured to correct the ambient temperature by a predetermined amount to account for the heat generated when the refrigerant is compressed during the recovery operation.

Figure 5:
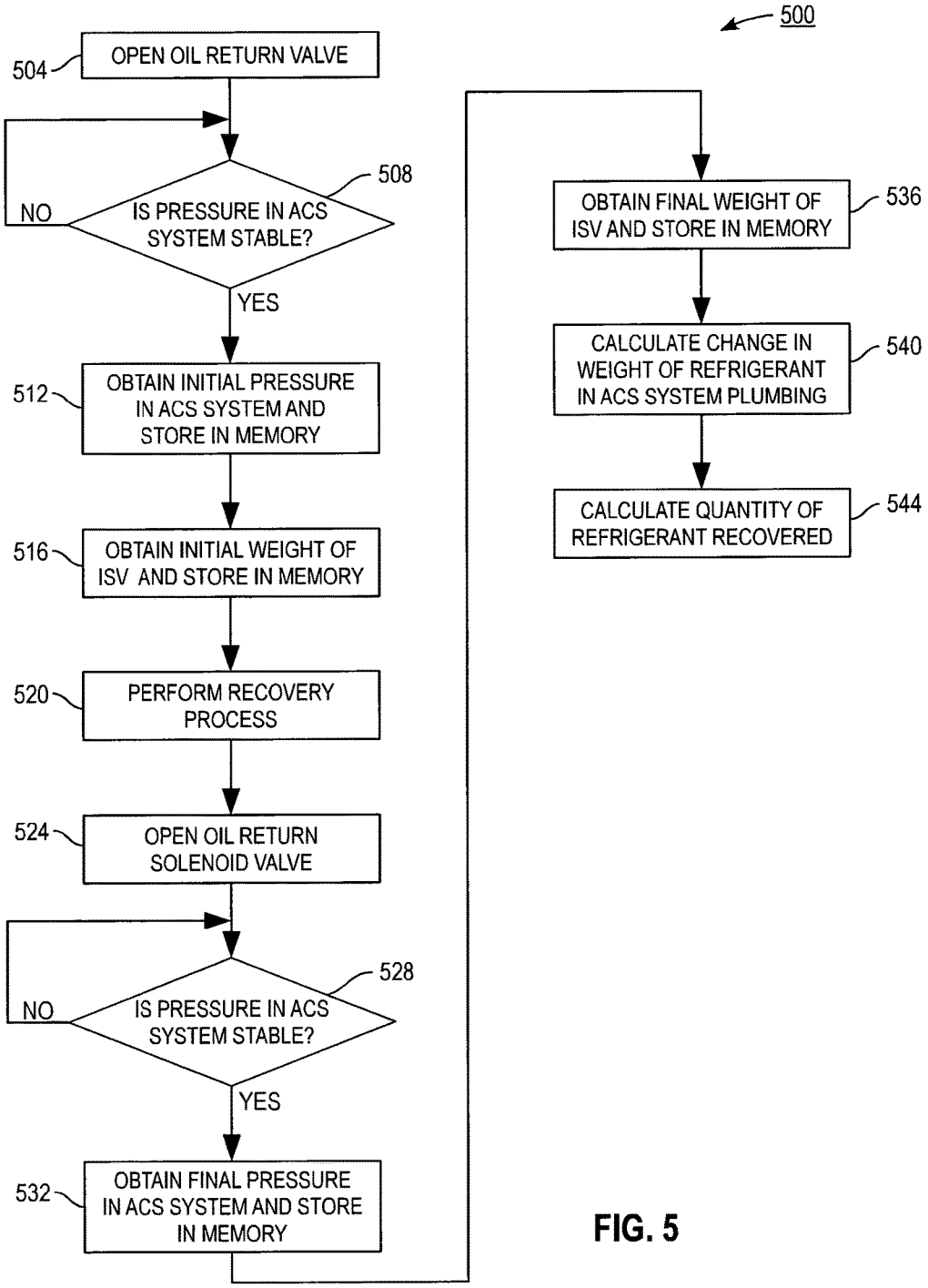
FIG. 5 is a process diagram of a method of operating an ACS system to perform a recovery operation and accurately determine the quantity of refrigerant recovered.

FIG. 5 illustrates a method 500 for operating a refrigerant recovery system, for example the ACS system 10 of FIG. 3, to recover refrigerant from a refrigeration system, for example an air conditioning circuit. The controller of the refrigerant service system includes a processor configured to execute programmed instructions stored in a memory associated with the controller to implement the method 500.

The method 500 begins with the controller operating the oil return valve 184 to open (block 504). Pressurized refrigerant in the high-pressure plumbing and the components of the system flows through the oil return line into the plumbing and components of the ACS system 10 on the low-pressure side of the compressor 18. The controller 20 then obtains a signal from the pressure transducer 192 in the low-pressure side of the ACS system 10, representing, for example, the pressure in the system oil separator 128. The signal data is stored in memory, and the controller 20 evaluates the data stored in the memory to determine whether the pressure in the ACS system 10 is stable (block 508). If the pressure in the ACS system 10 is not yet stable, then the controller 20 repeats block 508 to continue monitoring the pressure until the pressure stabilizes.

Once the pressure in the ACS system 10 has stabilized, the controller 20 obtains the initial pressure in the ACS system 10 from the pressure transducer 192 and stores the initial pressure in the memory (block 512). The controller 20 also obtains the initial weight of the ISV 14 from the ISV scale 118, and stores the initial weight in the memory (block 516). In some embodiments, the controller 20 is further configured to obtain an initial temperature signal from a temperature sensor 196 or 198 in the ACS system 10 and store the initial temperature value in the memory. The controller 20 is configured to then perform a recovery process to recover and purify the refrigerant from an air conditioning system to which the ACS system 10 is connected (block 520).

Upon completion of the recovery of the refrigerant, the portions of the ACS system 10 to the high pressure side 210 of the compressor 18 include a quantity of pressurized refrigerant, while the portions of the ACS system 10 to the low pressure side 206 of the compressor 18 are at a vacuum pressure. The controller 20 operates the oil return solenoid valve (block 524) to open to again equalize the pressure between the low and high pressure sides of the ACS system 10. The controller 20 obtains a signal from the pressure transducer 192 in the low-pressure side of the system, stores the signal data in memory, and evaluates the data stored in the memory to determine whether the pressure in the ACS system 10 is stable (block 528). If the pressure in the ACS system 10 is not yet stable, then the controller repeats block 528 to continue monitoring the pressure until the pressure stabilizes.

Once the pressure in the ACS system 10 has stabilized, the controller 20 obtains the final pressure in the ACS system 10 from the pressure transducer 192 and the final pressure is stored in the memory (block 532). The controller 20 also obtains the final weight of the ISV 14 from the ISV scale 118 and stores the final weight in the memory (block 536). In some embodiments, the controller 20 is further configured to obtain a final temperature signal from the temperature sensor 196 or 198 in the ACS system 10 and store the final temperature value in the memory.

The controller 20 is configured to calculate the change of mass of the refrigerant in the plumbing and chambers of the ACS system 10 using the ideal gas law (block 540). Based on the known volume of the plumbing and chambers within the system (V), which is stored in the memory, the measured pressure in the system (P), a temperature value that is either measured by a temperature sensor or assumed to be constant and is also stored in the memory (T), and the ideal gas constant (R) stored in the memory, the controller is configured to solve the ideal gas law for the quantity of refrigerant (n) using the ideal gas law:

$$P*V=n*R*T$$

Solving for n:

$$n = \frac{PV}{RT}$$

As above, in order to solve for the mass of the gas, the number of moles is multiplied by the molar mass (M) of the gas. The resulting equation for the mass of the refrigerant (m) remaining then becomes:

$$m = M\frac{PV}{RT}$$

The molar mass is constant for a particular refrigerant, and the volume of the high-side of a particular ACS system is constant. As such, the equation can be simplified to:

$$m = k\frac{P}{T}$$

where k represents MV/R, which is constant for a particular ACS system using a particular refrigerant.

The controller 20 is configured to perform this calculation a first time using the initial pressure ($P_1$) and, if measured, initial temperature ($T_1$), and a second time using the final pressure ($P_2$) and, if measured, final temperature ($T_2$). The change in mass (Δm) in the plumbing and chambers of the system is therefore:

$$\Delta m = m_2 - m_1 = k\left(\frac{P_2}{T_2} - \frac{P_1}{T_1}\right) = \frac{MV}{R}\left(\frac{P_2}{T_2} - \frac{P_1}{T_1}\right)$$

To convert the change in mass (Δm) to weight, the change in mass (Δm) is multiplied by the gravitational constant (g). The resulting change in weight ($\Delta W_{ref}$) of refrigerant in the plumbing and chambers of the system can be represented as:

$$\Delta W_{ref} = \frac{gMV}{R}\left(\frac{P_2}{T_2} - \frac{P_1}{T_1}\right)$$

The controller 20 subtracts the initial weight from the final weight to determine the change of weight of refrigerant in the plumbing and chambers of the system. The controller is configured to calculate the total quantity of refrigerant by subtracting the initial ISV weight ($W_{1,isv}$) from the final ISV weight ($W_{2,isv}$), and adding the change of weight in the plumbing and chambers of the system ($\Delta W_{ref}$) (block 544). The resultant value is the total quantity of refrigerant recovered from the air conditioning system ($W_{rec}$) during the recovery process:

$$W_{rec} = W_{2,isv} - W_{1,isv} - \Delta W_{ref} = W_{2,isv} - W_{1,isv} - \frac{gMV}{R}\left(\frac{P_2}{T_2} - \frac{P_1}{T_1}\right)$$

The reader should appreciate that, while the above process determines the weight of refrigerant recovered, the mass of the refrigerant recovered can be determined using the same process, except the sensed weights of the ISV are converted to mass by dividing by the gravitational constant instead of multiplying the mass of the refrigerant by the gravitational constant.

Figure 6:
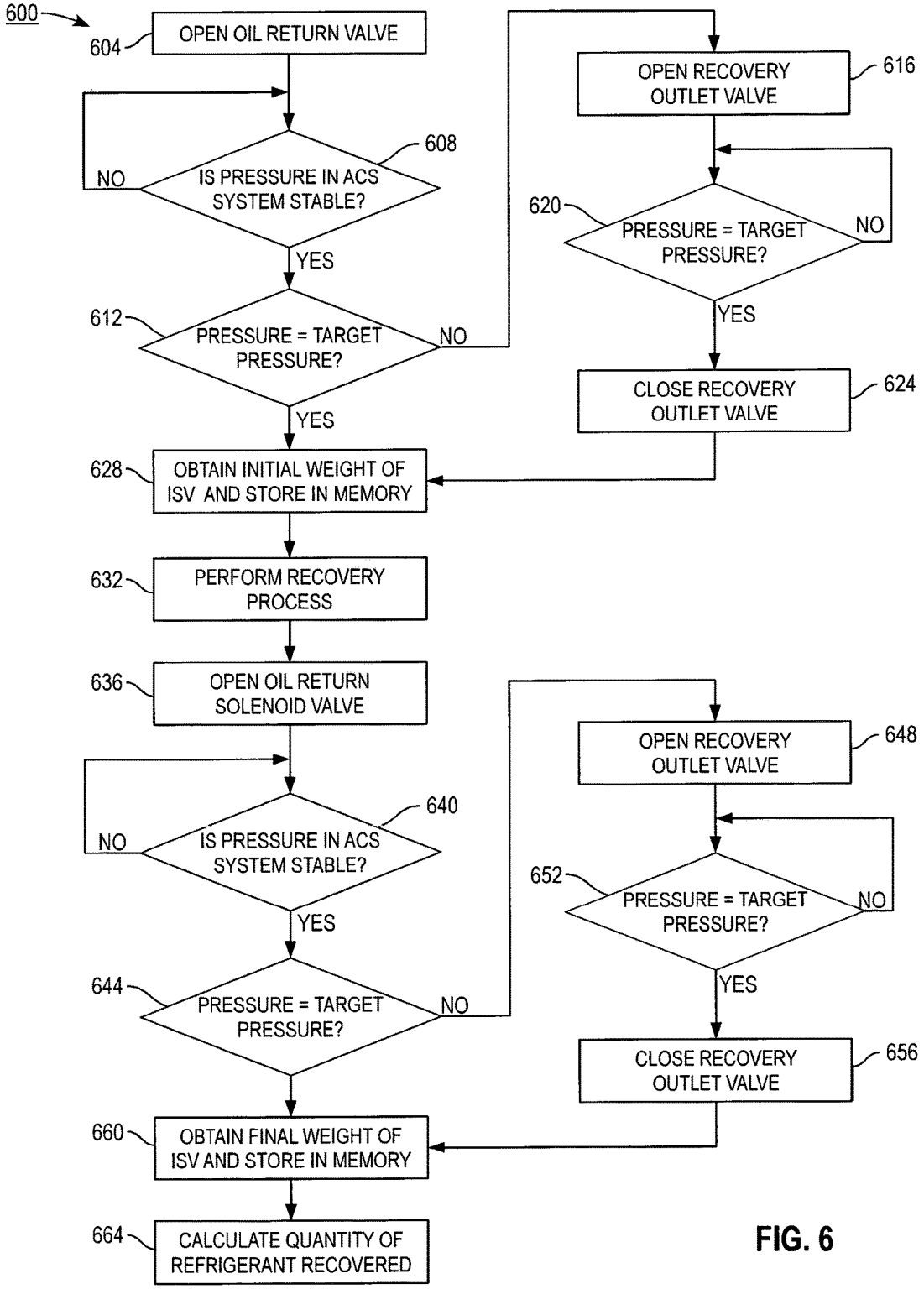
FIG. 6 is a process diagram of another method of operating an ACS system to perform a recovery operation and accurately determine the quantity of refrigerant recovered.

FIG. 6 illustrates another method 600 for operating a refrigerant recovery system, for example the refrigerant service system 10 of FIG. 3, to perform a refrigerant recovery operation that compensates for the refrigerant remaining in the plumbing and chambers of the ACS system without performing compensation calculations. The controller of the refrigerant service system includes a processor configured to execute programmed instructions stored in a memory associated with the controller to implement the method 600.

The method 600 begins with the controller operating the oil return valve 184 to open (block 604). Pressurized refrigerant in the high-pressure plumbing of the ACS system 10 flows through the oil return line into the plumbing and chambers on the low-pressure side of the ACS system 10. The controller 20 then obtains a signal from the pressure transducer 192 in the low-pressure side of the ACS system 10, for example the pressure in the system oil separator 128, stores the signal data in memory, and evaluates the data stored in the memory to determine whether the pressure in the ACS system 10 is stable (block 608). If the pressure in the ACS system 10 is not yet stable, then the controller 20 repeats block 608 to monitor the pressure in the ACS system 10 until the pressure stabilizes.

Next, the controller 20 evaluates the pressure value to determine whether the pressure in the ACS system 10 is at a target pressure, which is stored in the memory associated with the controller (block 612). If the pressure is not at the initial target pressure, then the controller 20 is configured to open the recovery outlet valve 180 (block 616), thereby allowing the pressurized refrigerant in the ISV 14 to flow back into the plumbing and chambers of the ACS system 10. The controller monitors the pressure signal received from the pressure transducer 192 and evaluates whether the pressure in the ACS system 10 has increased to the target pressure (block 620). If the pressure is not at the target pressure, then the controller 20 continues to monitor and evaluate the pressure signal (block 620). Once the pressure signal has reached the target pressure, the controller 20 operates the recovery outlet valve 180 to close, stopping the flow of refrigerant from the ISV 14 into the plumbing and chambers of the ACS system 10 (block 624).

The controller 20 obtains an initial weight reading representing the initial weight of the ISV 14 from the ISV scale 118 and stores the initial weight value in the memory (block 628). The controller 20 is then configured to perform a recovery process to recover and purify the refrigerant from an air conditioning system to which the ACS system 10 is connected (block 632).

Upon completion of the recovery process, the portions of the ACS system 10 on the high pressure side of the compressor are pressurized and include a quantity of refrigerant, while the portions of the ACS system 10 on the low pressure side of the compressor are at a vacuum pressure. The controller 20 opens the oil return solenoid valve 184 (block 636) to equalize the pressure between the low pressure and high pressure sides of the ACS system 10. The controller 20 then obtains a signal from the pressure transducer 192 in the low-pressure side of the system, stores the signal data in memory, and evaluates the data stored in the memory to determine whether the pressure in the ACS system 10 is stable (block 640). If the pressure in the ACS system is not yet stable, then the controller 20 repeats block 640 to continue monitoring the pressure in the ACS system 10 until the pressure stabilizes.

Next, the controller determines whether the pressure in the ACS system 10 is at the target pressure (block 644). If the pressure is not at the initial target pressure, then the controller 20 is configured to operate the recovery outlet valve 180 to open (block 648), thereby allowing the pressurized refrigerant in the ISV 14 to flow back into the plumbing and chambers of the ACS system 10. The controller 20 monitors the pressure signal received from the pressure transducer and evaluates whether the pressure in the ACS system 10 has increased to the target pressure (block 652). If the pressure is not at the target pressure, then the controller 20 continues to monitor and evaluate the pressure signal (block 652). Once the pressure signal indicates that the pressure in the ACS system 10 has reached the target pressure, the controller 20 operates the recovery outlet valve 180 to close (block 656) and obtains the final weight of the ISV 14 from the ISV scale 118. The final weight of the ISV 14 is then stored in the memory (block 660)

Since the pressure in the ACS system 10 is equal to the target pressure both before and after the recovery process, it can be assumed that the weight of refrigerant in the plumbing and components of the ACS system has not changed during the recovery process. As such, the change in weight of the ISV 14 represents the total quantity of refrigerant recovered, and no correction is necessary for refrigerant remaining in the plumbing and chambers of the ACS system 10. The controller 20 therefore calculates the total quantity of refrigerant recovered during the recovery operation as the difference between the final weight of the ISV 14 and the initial weight of the ISV 14 (block 664).

The ACS system 10 and methods of operating the ACS system 10 described herein do not require a clearing process in order to accurately determine the amount of refrigerant recovered. The ACS system therefore does not require the check valves and control solenoids that are specific to the clearing process, reducing the overall cost and complexity of the ACS system 10. In addition, the ACS system 10 and the methods described here perform the recovery operation without clearing the system, which enables the overall refrigerant recovery operation to be performed in less time. In some instances, for example, the ACS system 10 and methods described herein reduce the time required to complete the refrigerant recovery operation by approximately one minute.

It will be appreciated that variants of the above-described and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the foregoing disclosure.

The invention claimed is:

1. An air conditioning service system comprising:

a plurality of conduits and chambers defining a total refrigerant receiving volume of the air conditioning service system;

a pressure transducer configured to sense a pressure at a first location in the plurality of conduits and chambers;

a compressor operably connected to the plurality of conduits and chambers; and a controller operably connected to the pressure transducer and the compressor, the controller including a processor configured to execute program instructions stored in a memory to determine a quantity of refrigerant recovered from a refrigeration system by:

obtaining a first pressure signal from the pressure transducer corresponding to a first pressure at the first location, operating the compressor to recover the refrigerant from the refrigeration system after the first pressure is sensed, obtaining a second pressure signal from the pressure transducer corresponding to a second pressure at the first location after operating the compressor, and determining an amount of refrigerant recovered from the refrigeration system based on the first pressure signal and the second pressure signal.

2. The system of claim 1, wherein the controller is configured to execute the program instructions to determine the quantity of refrigerant recovered by determining a change in mass of refrigerant in the conduits and chambers from before operating the compressor to after operating the compressor based on the first and second pressure signals, and determining the amount of refrigerant recovered from the refrigeration system based on the determined change in mass.

3. The system of claim 2, wherein the controller is configured to execute the program instructions to determine the change in mass of refrigerant based upon the following equation:

$$\Delta m = \frac{MV}{R}\left(\frac{P_2}{T_2} - \frac{P_1}{T_1}\right)$$

wherein:

$\Delta m$ is the change in mass of refrigerant,

M is a molar mass of the refrigerant,

V is a volume fluidly connected to the first location,

R is the universal gas constant, $P_2$ is the second pressure, $T_2$ is a second temperature associated with the second pressure, $P_1$ is the first pressure, and $T_1$ is a first temperature associated with the first pressure.

4. The system of claim 3, further comprising:

a refrigerant storage vessel; and a scale configured to sense a weight of the refrigerant storage vessel, wherein the controller is operably connected to the scale and is further configured to execute the program instructions to determine the quantity of refrigerant recovered by:

obtaining a first weight signal from the scale corresponding to a first weight of the refrigerant storage vessel prior to operating the compressor, obtaining a second weight signal from the scale corresponding to a second weight of the refrigerant storage vessel after operating the compressor, and wherein the determining of the amount of refrigerant recovered from the refrigeration system is based on the first weight signal, the second weight signal, the first pressure signal, and the second pressure signal.

5. The system of claim 4, wherein the controller is configured to execute the program instructions to determine the amount of refrigerant recovered from the refrigeration system based upon the following equation:

$$W_{rec} = W_{2,isv} - W_{1,isv} - \frac{gMV}{R}\left(\frac{P_2}{T_2} - \frac{P_1}{T_1}\right)$$

wherein:

$W_{rec}$ is the amount of refrigerant recovered from the refrigeration system expressed as a weight, $W_{2,isv}$ is the second weight of the refrigerant storage vessel, $W_{1,isv}$ is the first weight of the refrigerant storage vessel, and g is the gravitational constant.

6. The system of claim 3, further comprising:

a temperature sensor configured to sense a temperature of the air conditioning service system, wherein the controller is operably connected to the temperature sensor and is configured to execute the program instructions to determine the quantity of refrigerant recovered by:

obtaining a first temperature signal from the temperature sensor corresponding to the first temperature, and obtaining a second temperature signal from the temperature sensor corresponding to the second temperature.

7. The system of claim 1, wherein:

the plurality of conduits and chambers includes a first portion connected to a high pressure side of the compressor and a second portion connected to a low pressure side of the compressor, the air conditioning system further comprises a valve configured to control a connection between the first portion and the second portion, the pressure transducer is configured to sense a pressure in the second portion, and the controller is operably connected to the valve and is configured to execute the program instructions to determine the quantity of refrigerant recovered by:

operating the valve to an open position to equalize pressure between the first portion and the second portion prior to obtaining the first pressure signal, and operating the valve to an open position to equalize pressure between the first portion and the second portion after operating the compressor and prior to obtaining the second pressure signal.

8. The system of claim 1, wherein:

the plurality of conduits and chambers includes a first portion connected to a high pressure side of the compressor and a second portion connected to a low pressure side of the compressor, and the pressure transducer is configured to sense a pressure in the first portion.

9. A method of operating an air conditioning service system to determine a quantity of refrigerant recovered from a refrigeration system comprising:

obtaining, with a controller, a first pressure signal from a pressure transducer corresponding to a first pressure at a first location in a plurality of conduits and chambers defining a total refrigerant receiving volume of the air conditioning service system;

operating, using the controller, a compressor to recover the refrigerant from the refrigeration system after the first pressure is sensed by the pressure transducer;

obtaining, with the controller, a second pressure signal from the pressure transducer corresponding to a second pressure at the first location after operating the compressor; and determining, with the controller, an amount of refrigerant recovered from the refrigeration system based on the first pressure signal and the second pressure signal.

10. The method of claim 9, further comprising:

determining, with the controller a change in mass of refrigerant in the conduits and chambers from before operating the compressor to after operating the compressor based on the first and second pressure signals; and determining the amount of refrigerant recovered from the refrigeration system based on the determined change in mass.

11. The method of claim 10, wherein the determining of the change in mass of refrigerant based upon the following equation:

$$\Delta m = \frac{MV}{R}\left(\frac{P_2}{T_2} - \frac{P_1}{T_1}\right)$$

wherein:

$\Delta m$ is the change in mass of refrigerant,

M is the molar mass of the refrigerant,

V is a volume fluidly connected to the first location,

R is the universal gas constant, $P_2$ is the second pressure, $T_2$ is a second temperature associated with the second pressure, $P_1$ is the first pressure, and $T_1$ is a first temperature associated with the first pressure.

12. The method of claim 11, further comprising:

obtaining a first weight signal from a scale configured to sense a weight of a refrigerant storage vessel operably connected to the plurality of conduits and chambers, the first weight signal corresponding to a first weight of the refrigerant storage vessel prior to operating the compressor;

obtaining a second weight signal from the scale corresponding to a second weight of the refrigerant storage vessel after operating the compressor; and wherein the determining of the amount of refrigerant recovered from the refrigeration system is based upon the first weight signal, the second weight signal, the first pressure signal, and the second pressure signal.

13. The method of claim 12, wherein the determining of the amount of refrigerant recovered from the refrigeration system is based upon the following equation:

$$W_{rec} = W_{2,isv} - W_{1,isv} - \frac{gMV}{R}\left(\frac{P_2}{T_2} - \frac{P_1}{T_1}\right)$$

wherein:

$W_{rec}$ is the amount of refrigerant recovered from the refrigeration system expressed as a weight, $W_{2,isv}$ is the second weight, $W_{1,isv}$ is the first weight, and g is the gravitational constant.

14. The method of claim 11, further comprising:

obtaining a first temperature signal from a temperature sensor configured to sense a temperature of the air conditioning service system, the first temperature signal corresponding to the first temperature; and obtaining a second temperature signal from the temperature sensor corresponding to the second temperature.

15. The method of claim 9, further comprising:

operating, with the controller, prior to obtaining the first pressure signal, a valve to an open position to fluidly connect a first portion of the plurality of conduits and chambers connected to a high pressure side of the compressor and a second portion of the plurality of conduits and chambers connected to a low pressure side of the compressor to equalize pressure between the first portion and the second portion; and operating, with the controller, the valve to an open position to equalize pressure between the first portion and the second portion after operating the compressor and prior to obtaining the second pressure signal, wherein the pressure transducer is configured to sense a pressure in the second portion.

16. The method of claim 9, wherein:

the plurality of conduits and chambers includes a first portion connected to a high pressure side of the compressor and a second portion connected to a low pressure side of the compressor, and the pressure transducer is configured to sense a pressure in the first portion.

* * * * *